US006820673B2

(12) United States Patent
Wessels

(10) Patent No.: US 6,820,673 B2
(45) Date of Patent: Nov. 23, 2004

(54) AWNING, ESPECIALLY ARTICULATED ARM AWNING

(75) Inventor: Bernhard Wessels, Rheine (DE)

(73) Assignee: Schmitz—Werke GmbH + Co. KG, Emsdetten (DE)

( * ) Notice: Subject to any disclaimer, the term of this patent is extended or adjusted under 35 U.S.C. 154(b) by 0 days.

(21) Appl. No.: 10/316,039

(22) Filed: Dec. 11, 2002

(65) Prior Publication Data

US 2003/0106649 A1 Jun. 12, 2003

(30) Foreign Application Priority Data

Dec. 11, 2001 (DE) ..... 101 60 784

(51) Int. Cl.[7] ..... E04F 10/06
(52) U.S. Cl. ..... 160/70; 160/56
(58) Field of Search ..... 160/56, 70, 79; 135/88.1, 88.11

(56) References Cited

U.S. PATENT DOCUMENTS 714,187 A * 11/1902 Johnson et al. ..... 160/56
2,038,258 A * 4/1936 Anton ..... 160/70
6,581,664 B2 * 6/2003 Kroner et al. ..... 160/70

FOREIGN PATENT DOCUMENTS

DE 4402964 8/1995
DE 100 35 797 1/2002

* cited by examiner

*Primary Examiner*—Blair M. Johnson
(74) *Attorney, Agent, or Firm*—Browdy & Neimark, P.L.L.C.

(57) ABSTRACT

An awning, especially an articulated arm awning, comprises an awning cloth that can be wound up in the form of a cloth roll and a front bar that is disposed at the free outer end of the awning cloth, connected to the same, said front bar incorporating at least one swivel joint having an approximately horizontal or forwarded tilted swivel axis.

7 Claims, 4 Drawing Sheets

AWNING, ESPECIALLY ARTICULATED ARM AWNING

BACKGROUND OF THE INVENTION

1. Field of the Invention

The present invention is directed to an awning, especially an articulated arm awning, comprising an awning cloth that can be wound up into a cloth roll and a front bar that is disposed at the free outer end of the awning cloth, connected to the same.

2. Background of the Invention

Awnings of this type in their extended position have the problem, particularly during heavy rains, that the rainwater does not run off in a defined and continuous manner, but the awning cloth bulges and accumulations of water accordingly form in the region in front of the front bar, which, due to the relatively great lever arm, subject the awning structure to significant stress. Furthermore, the water carries with it dirt particles, which then also do not run off with the water but can remain as unsightly stains after the accumulated water has dried off.

SUMMARY OF THE INVENTION

Based on this, the invention has as its object to improve an awning of the above type in such a way that an even water runoff can be attained while preventing water accumulations, and new design options are opened up at the same time.

This object is met according to the invention in such a way that the front bar incorporates at least one swivel joint with an approximately horizontal axis. Approximately horizontal, in this context, also means the usual forward tilt of awnings of this type of, e.g., 30°. A swivel axis of this type permits the front bar to be folded centrically up or down, for example, and, hence, impress onto an awning cloth that is fastened to the front bar a corresponding fold, so that rainwater will either, like with a gable roof, run off to the side in case of an upward fold, or, in case of a downward fold, run off in a defined manner within the region of the horizontal swivel axis. The swivel joint is preferably executed as a hinge, to attain sufficient stability.

A coupling means is advantageously provided such that when the awning is extended, the same is folded around its horizontal swivel axis, either up, similar to a gable roof, or down, and when the awning or front bar is retracted, the front bar is moved into a straight position. A separate activity is therefore not required to create the folded position of the front bar.

It is also possible, of course, within the frame of the invention, to dispense with an automatic folding and provide a locking means in the region of the horizontal swivel joint, in order to create a folded position only after releasing such a locking means.

In an alternate embodiment, the coupling means may be formed by a cable pull mechanism, which engages at the articulated arm sections and accomplishes the folding of the front bar. To the extent in which a cable pull mechanism is mentioned here, the term "cable" shall be understood in the broadest sense as a flexible force transmission medium, i.e., belts, straps, chains, or the like may, of course, be considered as well.

In a further embodiment, provision is made for the coupling means to be formed by articulated arm sections that are swivel-mounted at least in sections around an approximately horizontal swivel axis, so that this swivel movement is transferable to the given front bar sections, and a folding of the front bar is attained in this manner.

If the given outer articulated arm section is connected via a universal joint to the front bar, this universal joint may be selectively blocked or released, e.g., by means of a pin, to cause the front bar to fold by blocking, or prevent its folding by releasing.

The swivel joint that is formed between the outer and inner articulated arm section preferably has a swivel axis that is tilted against the vertical plane and advantageously disposed offset from the center longitudinal axis of the inner and outer articulated arm section, preferably on an offset curvature. The inventive design achieves not only a problem-free water runoff but it furthermore opens up completely novel design options, for instance by permitting the awnings to take a shape similar to a gable roof. If, for example, like on the window front of a department store, multiple awnings of this type are disposed side by side, it is possible, for example, to work only with awnings that are folded up like a gable roof, or to place alternating awnings, one folded up and one folded down, side by side in order to create a type of jagged peaks structure.

The invention will be explained in more detail below based on preferred embodiments in conjunction with the drawing.

DESCRIPTION OF THE PREFERRED EMBODIMENTS

Figure 1:
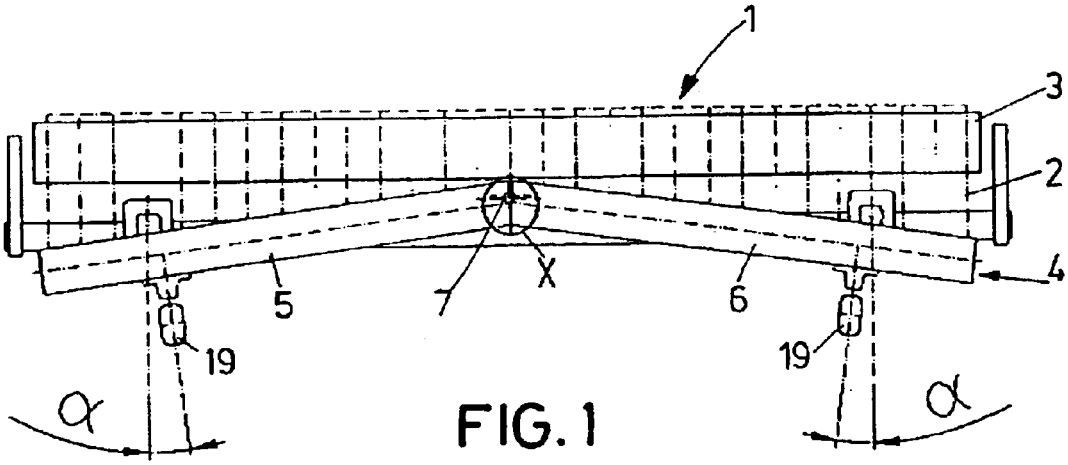
FIG. 1 shows a schematic view of an inventive awning with a front bar that can be folded up from the center.

An articulated arm awning 1 shown in the drawing comprises an awning cloth 2 which, beginning with its back end, can be wound onto a cloth roll 3. The free outer end of the awning cloth 2 is connected to a front bar 4, which, in the shown embodiment, comprises two sections 5, 6 that are connected to one another via a hinge-like swivel joint 7, wherein the swivel joint in the embodiment of FIG. 1 is executed such that (see FIG. 3) the front bar sections 5, 6 in the extended position are folded up, and in the embodiment of FIG. 2 (see FIG. 4) such that the front bar sections 5, 6 in their extended position are folded down.

Extending the front bar 4 and thus the awning cloth 2 is performed via articulated arms 8 that each comprise an inner articulated arm section 9 and an outer articulated arm section 10.

The inner articulated arm section 9 is supported swivel-mounted on the wall around a swivel bearing with a vertical swivel axis 11 (the swivel bearing as such and the attachment to the wall are not shown in the drawing) and connected to the outer articulated arm section 10 via a swivel joint 12 with a swivel axis 13.

Figure 5:
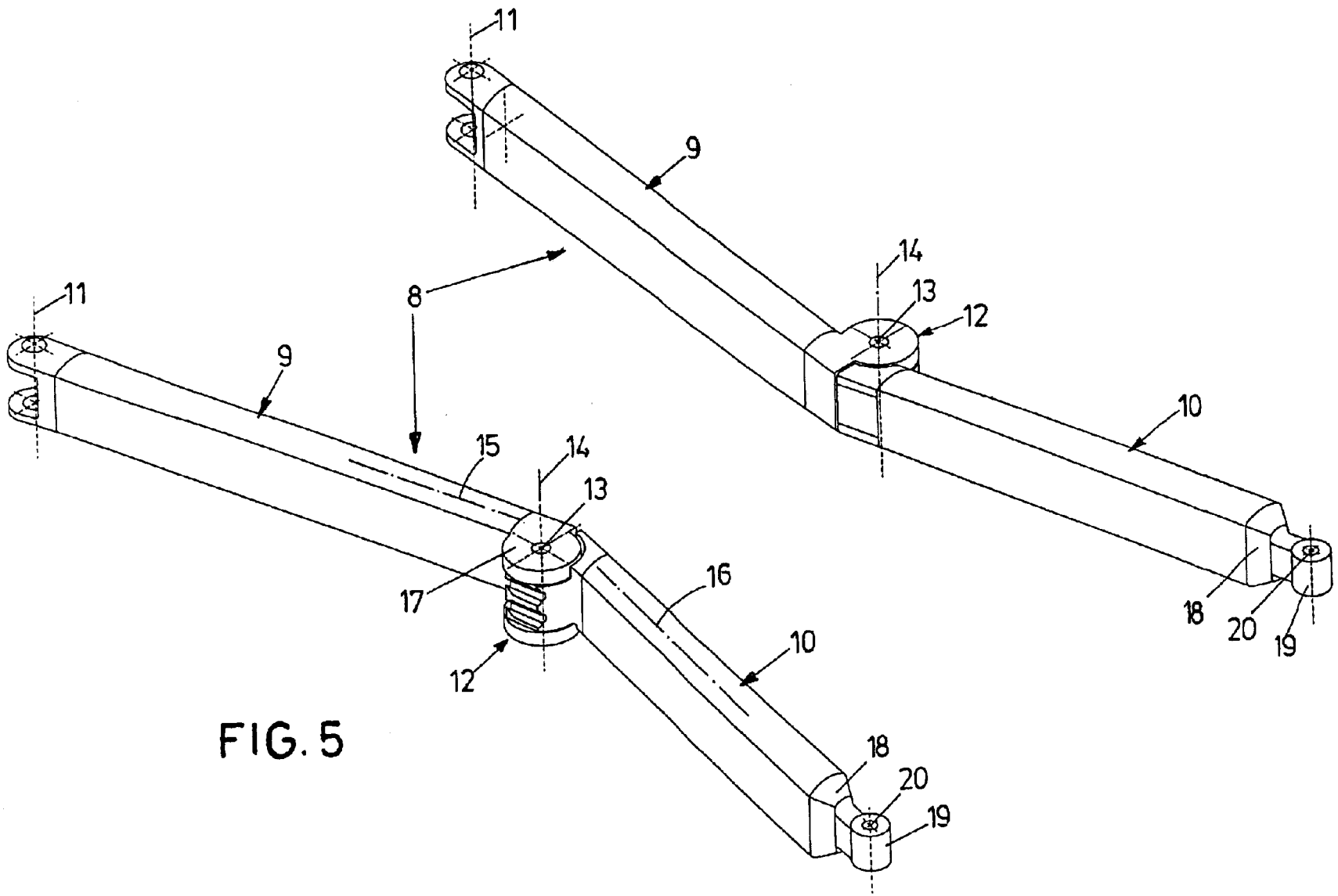
FIG. 5 shows a view in the perspective of the joints in the extended position.
Figure 6:
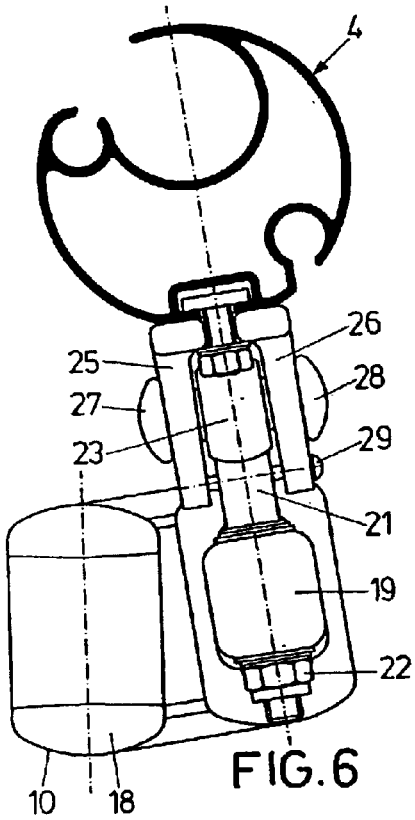
FIG. 6 shows a section through the front bar, or view along the front bar, in the retracted position with the universal joint locked.

The swivel axis 13 is disposed in an offset curvature 17 of the inner articulated arm section 9, offset from the center longitudinal axes 15 and 16 of the inner articulated arm section 9 and outer articulated arm section 10, said offset curvature 17 being solidly connected to the inner articulated arm section 9. The swivel axis 13 is furthermore located on the angle bisecting line of the plane perpendicular to the center longitudinal axes 15 and 16. The outer end 18 of the outer articulated arm section 10, as can be seen from FIG. 5, is connected by gimbal mounting to the front bar 4 in such a way that the outer end 18 of the outer articulated arm section 10 has a projection 19 with a bearing hole 20, which is penetrated by a swivel pin 21, which is secured with a fastening nut 22 from underneath and, in turn, has at its upper side a support eye 23 for a horizontal support pin 24, which is supported on both sides of the support eye 23 in projections 25, 26 of the front bar 4 and secured by means of lateral caps 27, 28.

Figure 2:
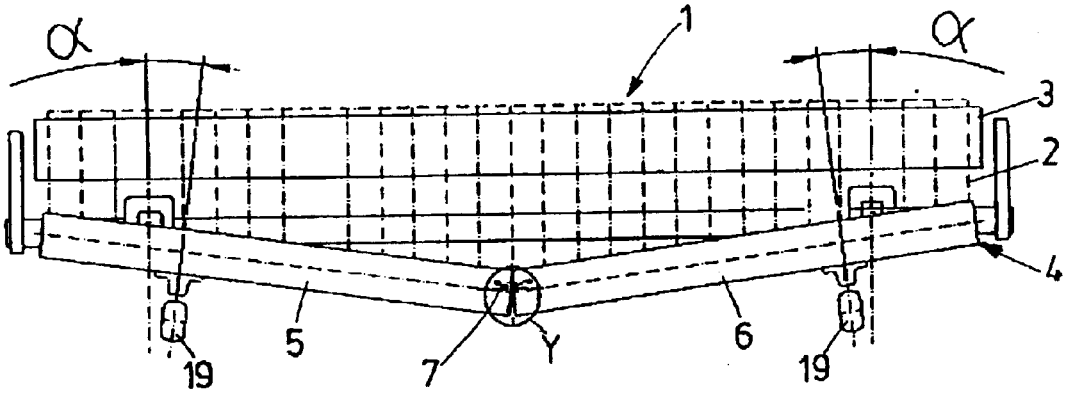
FIG. 2 shows a front view corresponding to FIG. 1 of an embodiment with a front bar that can be folded down from the center.
Figure 3:
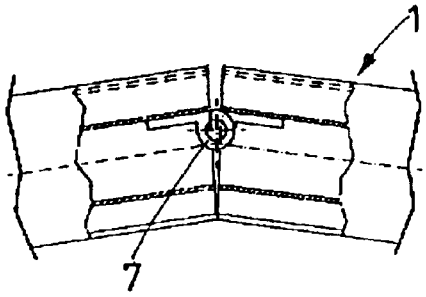
FIG. 3 shows the detail X in FIG. 1.
Figure 4:
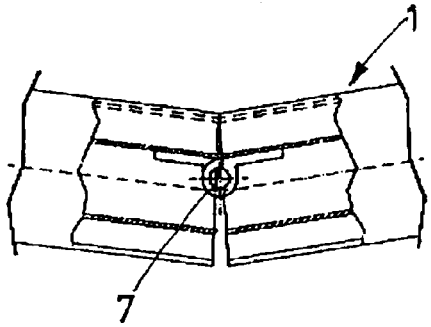
FIG. 4 shows the detail Y in FIG. 2.
Figure 7:
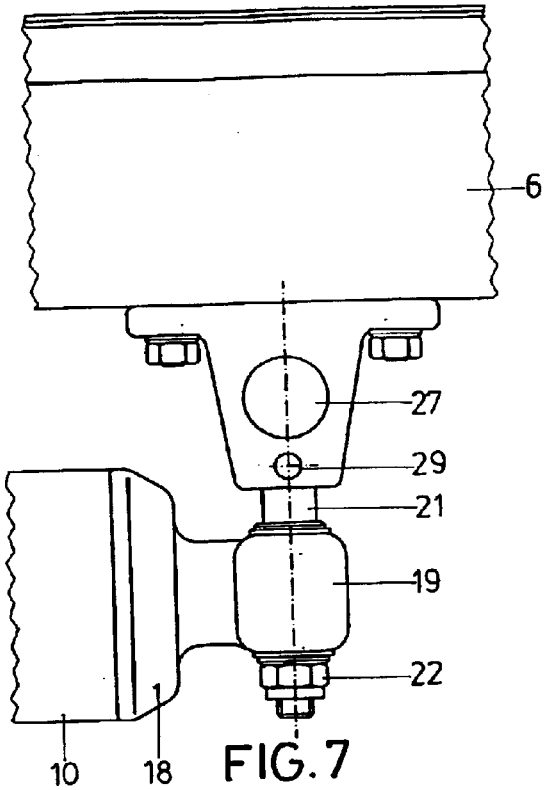
FIG. 7 is a representation corresponding to FIG. 6, viewed perpendicular to the front bar.

The effect of the above-described design will become clear in conjunction with FIGS. 7 through 10:

As shown in FIG. 7, in the retracted position, the inner articulated arm section 9 and outer articulated arm section 10 extend parallel to one another and in the course of the extension process, the outer articulated arm section 10 is swivelled relative to the inner articulated arm section 9 by an angle $\alpha$, with the result that the given section 5 or 6 of the front bar 4 that is fastened to the same is also swivelled up (according to the embodiment in FIGS. 1 and 3), or down (according to the embodiment in FIGS. 2 and 4).

Figure 8:
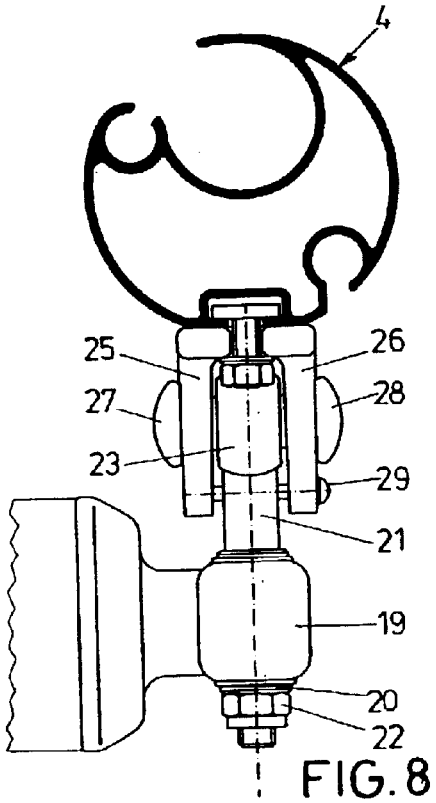
FIG. 8 is a representation corresponding to FIG. 6 in the extended position.
Figure 9:
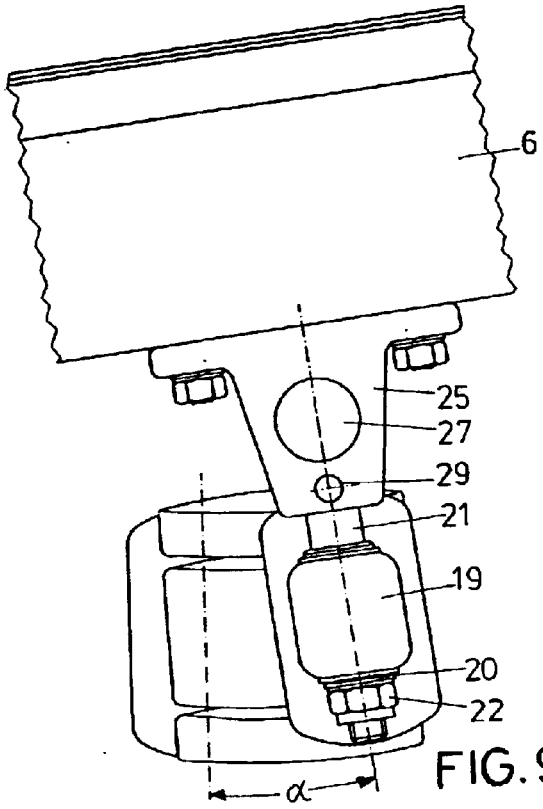
FIG. 9 is a representation corresponding to FIG. 7 in the extended position with a tilted front bar section.
Figure 10:
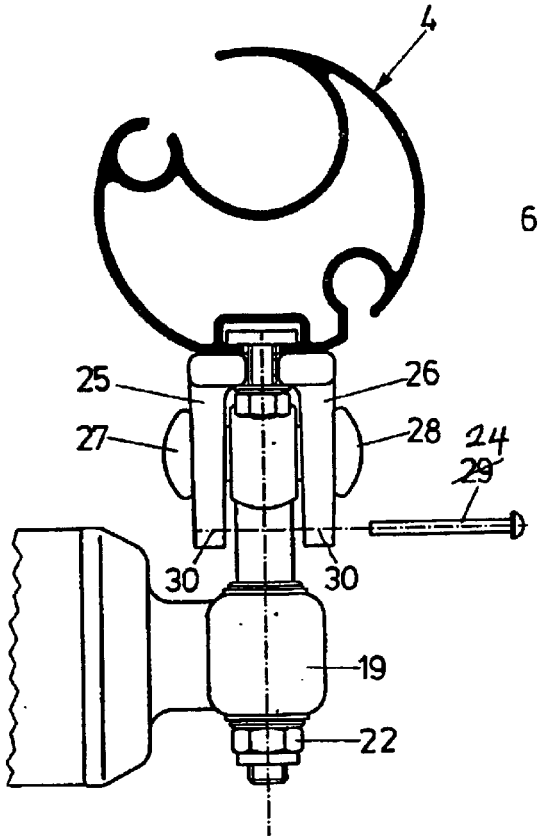
FIG. 10 is a representation corresponding to FIG. 6 with the universal joint released.
Figure 11:
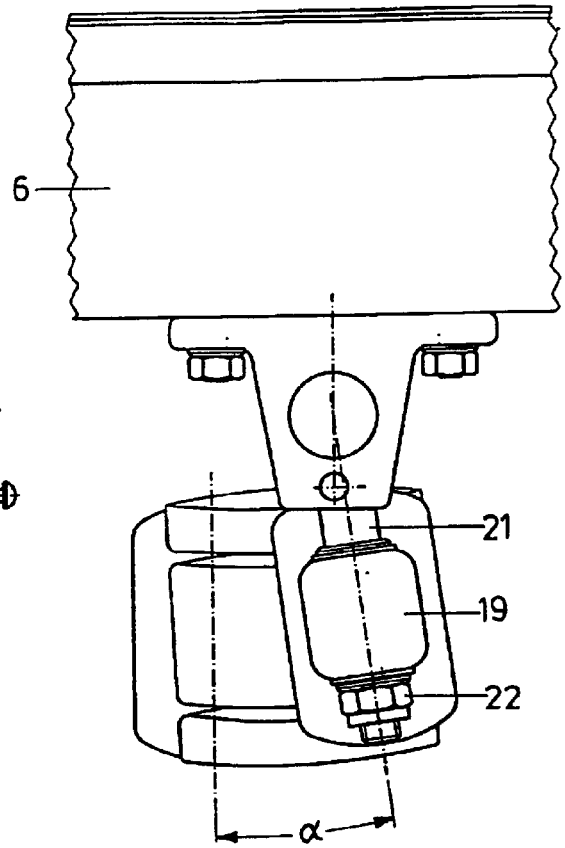
FIG. 11 is a representation corresponding to FIG. 9 with the universal joint released and the front bar section accordingly not tilted.

The projections 25, 26 incorporate borings 30 for a locking pin 29, which, when inserted, also penetrates a boring 31 of the swivel support pin 21 and, in this manner, blocks the swivel movement around the horizontal support pin 24. When the universal joint is blocked in this manner, the swivel movement of the outer articulated arm section 10 is transferred to the given section 6 of the front bar 4, as shown in FIGS. 8 and 9, whereas in the released position shown in FIGS. 10 and 11, the front bar 4 is not folded.

What is claimed is:

1. An awning comprising an awning cloth that can be wound up into a cloth roll and a front bar that is disposed at a free outer end of the awning cloth, connected to the same, wherein the front bar comprises at least one swivel joint connecting two sections of the front bar at a middle portion of the front bar, said swivel joint swiveling around an approximately horizontal or forward tilting swivel axis.

2. An awning according to claim 1, wherein the swivel joint comprises a hinge.

3. An awning according to claim 1, further comprising a coupling means for automatically folding the front bar around the swivel axis either up, or down when the front bar is extended and for moving the front bar into a straight position when the front bar is retracted.

4. An awning according to claim 3, wherein the coupling means comprises inner and outer articulated arms that swivel at least in sections around an approximately horizontal swivel axis.

5. An awning according to claim 4, further comprising a swivel hinge connecting the inner and outer articulated arms that swivels around a swivel axis in such a manner that the the outer articulated arm in an extended position is tilted inward or outward relative to a vertical plane by an angle $\alpha$, so that the two sections of the front bar that are fastened on the given articulated arm sections are accordingly tilted by an angle $\alpha$ along the horizontal plane.

6. An awning according to claim 5, wherein the swivel axis (13) of the swivel hinge is formed between the inner and outer articulated arm offset from a longitudinal center axis of the inner and outer articulated arms, on an offset curvature.

7. An awning according to claim 5, wherein a universal joint, which is blockable and releasable by blocking means, is formed between the outer articulated arm and the front bar.

* * * * *